US005230390A

United States Patent [19]

Zastresek et al.

[11] Patent Number: 5,230,390

[45] Date of Patent: Jul. 27, 1993

[54] SELF-CONTAINED CLOSURE MECHANISM FOR A CORE BARREL INNER TUBE ASSEMBLY

[75] Inventors: Jiri Zastresek, Salt Lake City; Steven R. Radford, South Jordan, both of Utah

[73] Assignee: Baker Hughes Incorporated, Houston, Tex.

[21] Appl. No.: 847,358

[22] Filed: Mar. 6, 1992

[51] Int. Cl.[5] ..... E21B 25/00

[52] U.S. Cl. ..... 175/232; 175/243; 175/317

[58] Field of Search ..... 175/232, 233, 241, 242, 175/246, 317, 243

[56] References Cited

U.S. PATENT DOCUMENTS

| | | | |
|---|---|---|---|
| 1,364,084 | 1/1921 | Dodds | 175/317 |
| 1,508,230 | 9/1924 | Lewis | 175/317 X |
| 1,619,328 | 1/1927 | Benckenstein | 175/243 X |
| 2,159,249 | 5/1939 | Brantley | 175/232 X |
| 2,239,586 | 4/1941 | Appleby | 175/317 |
| 3,907,046 | 9/1975 | Gaylord | 175/317 X |

*Primary Examiner*—David J. Bagnell
*Attorney, Agent, or Firm*—Trask, Britt & Rossa

[57] ABSTRACT

A closure mechanism for preventing fluid access to an inner tube of a core barrel assembly is disclosed in which the closure mechanism is configured to move from an open, or unoccluded, condition to an occluded condition in response to increased fluid flow rates and pressure differentials occurring at the closure mechanism. The closure mechanism is also configured to maintain occlusion of the inner tube under substantially all types of drilling conditions, and particularly those where conventional closure mechanisms may fail, such as in horizontal drilling. The closure mechanism generally includes a conduit structure associated with the inner tube, and having a seat, an occlusion structure, such as a ball, and releasing structure which maintains the occlusion structure in spaced relationship to the seat until increasing pressure differentials result in release of the occlusion structure to register with the seat.

22 Claims, 6 Drawing Sheets

SELF-CONTAINED CLOSURE MECHANISM FOR A CORE BARREL INNER TUBE ASSEMBLY

BACKGROUND

1. Field of Invention

This invention relates to core drilling apparatus which includes a mechanism for preventing flow of drilling mud through the inner tube of a core barrel. Specifically, this invention relates to closure mechanisms which register against a seat in the inner tube assembly in response to conditions existing in the drill string, and which are maintained in registration with or in close proximity to the seat under substantially all normally encountered drilling conditions.

2. State of the Art

Closure mechanisms associated with the inner tube of a core barrel which operate to prevent drilling mud or fluid from traveling down the inner tube are well known. In the field, drilling mud is pumped downwardly through the inner tube of a core barrel while the drill string is being run to the bottom of the well bore in order to prevent debris from entering the inner tube prior to commencement of the coring operation. Drilling fluid is continuously pumped through the inner tube until the drill bit reaches the bottom of the hole. Oftentimes, drilling mud is circulated for some time "on bottom" after the drill bit reaches bottom to ensure a clean inner tube prior to coring. Immediately before drilling begins, a mechanism, typically known as a drop ball mechanism, is activated in the inner tube assembly to close off the central bore of the inner tube. The drilling fluid is then diverted or rerouted to and through the annular space formed between the inner tube and outer barrel of the core barrel. The fluid is then directed through nozzles or other apertures which are in the core bit crown.

In some core drilling systems, a seat in provided in the upper portion of the inner tube assembly and a ball is dropped from the surface through the drill string to the core barrel, eventually coming into registration with the seat to close off the central bore of the core barrel above the inner tube. In other core drilling systems, a drop ball mechanism is positioned in the drill string, usually in a subsection (also referred to as a "sub") of the drill string. In response to a stimulus from the surface, such as increased fluid flow rate, the ball is released to drop down until it comes into registration with the seat.

The aforementioned closure mechanisms have limited utility and effectiveness in certain situations. For example, prior art closure mechanisms are not configured to maintain the ball against the seat when flow of drilling mud is stopped. The ball may drop away from the seat when drilling takes places horizontally, or when changes in pressure arising in the inner tube cause the ball to rise momentarily from the seat. It has been shown that in some coring situations, especially high angle or horizontal, once dislodged, the ball may have trouble seating again, allowing mud pressure to damage the core. Further, when a motor is being used downhole to rotate the drill bit the motor will obstruct access to the core barrel below the motor in the drill string, making many prior art ball dropping mechanisms impractical or impossible to use in such drill string configurations.

Therefore, it would be an improvement in the art to provide a self-contained closure mechanism associated with the inner tube assembly of a core barrel which is activated in response to conditions existing within the core barrel and which maintains the ball in immediate proximity to the seat under all drilling conditions. Such a mechanism also would be useful and highly desirable for utilization in other downhole applications where dropping a ball from the surface or from a sub in the drill string is undesirable or even impossible. Such applications include motor coring, coring with certain MWD (Measurement While Drilling) or other electronic devices, or turbine coring.

SUMMARY OF THE INVENTION

In accordance with the present invention, a closure mechanism is provided for the inner tube assembly of a core barrel, which mechanism occludes the central bore or conduit of the inner tube thereby preventing flow of fluid therethrough. The closure mechanism is structured to become activated, or to occlude the inner tube, in response to conditions existing in the drill string near the closure mechanism. The closure mechanism is further structured to maintain occlusion of the inner tube central bore under substantially all normally encountered drilling conditions subsequent to activation.

The closure mechanism generally includes occlusion means structured to come into registration with a seat formed in a conduit structure associated with the upper portion of the inner tube assembly. The closure mechanism further includes releasing structure associated with the occlusion means for maintaining the occlusion means in an inactivated, or non-occluding, position relative to the seat until conditions within the drill string cause the releasing structure to activate the occlusion means.

The occlusion means may be any structure which is conformable to or configured to register against the seat of the closure mechanism. Examples of such occlusion means include a steel ball, a ball formed of resilient or conformable material such as rubber, a frustoconically-shaped plug or the like. The occlusion means is maintained in a first position spaced apart from the seat of the closure means to allow drilling fluid to circulate thereabout and to enter into the central bore of the inner tube.

A release mechanism maintains the distance between the occlusion means and the seat while drilling fluid is being pumped down the drill string and through the inner tube. The release mechanism may, for example, be a collet-type structure which retains a ball or plug within a plurality of fingers until the ball or plug is released to register against the seat. Alternatively, the release mechanism may be a spring-biased mechanism which releases under pressure to bring a ball or plug into registration with the seat. The release mechanism may also comprise shear pins or screws which break to release the occlusion means.

The release mechanism is associated with a conduit structure, such as a pressure relief plug, which is positioned proximate the inner tube and in communication therewith. The release mechanism is configured to release, or activate, the occlusion means in response to a stimulus existing at or near the closure mechanism. For example, the release mechanism may be formed of a sturdy but resilient material which maintains the occlusion means in a first position apart from the seat under moderate pressures experienced due to fluid pressure exerted near the closure mechanism. However, under increased pressure due to an increase in fluid flow, the release mechanism gives way slightly to release the occlusion means to register against the seat.

The release mechanism and/or the occlusion means are further structured to maintain the occlusion means in registration against the seat or in the immediate vicinity thereof to prevent drilling fluid from flowing into the inner tube during coring. The closure mechanism is particularly structured to maintain occlusion of the inner tube central bore under non-vertical drilling conditions and to prevent the occlusion means from becoming dislodged to the extent of not being able to re-establish occlusion.

The occlusion means may be structured to be removable from the seat by conventional means known in the art, including resetting tools which are inserted down the drill string to retrieve the occlusion means and reset it within the release mechanism, as well as those which are inserted up through the seat, bringing the released occlusion means back to its first position. The closure mechanism need not necessarily be structured to provide resetting, however, but only as the particular requirements of the drilling operation dictate.

BRIEF DESCRIPTION OF THE DRAWINGS

In the drawings, which illustrate what is currently considered to be the best mode for carrying out the invention.

DETAILED DESCRIPTION OF THE ILLUSTRATED EMBODIMENTS

Figure 1:
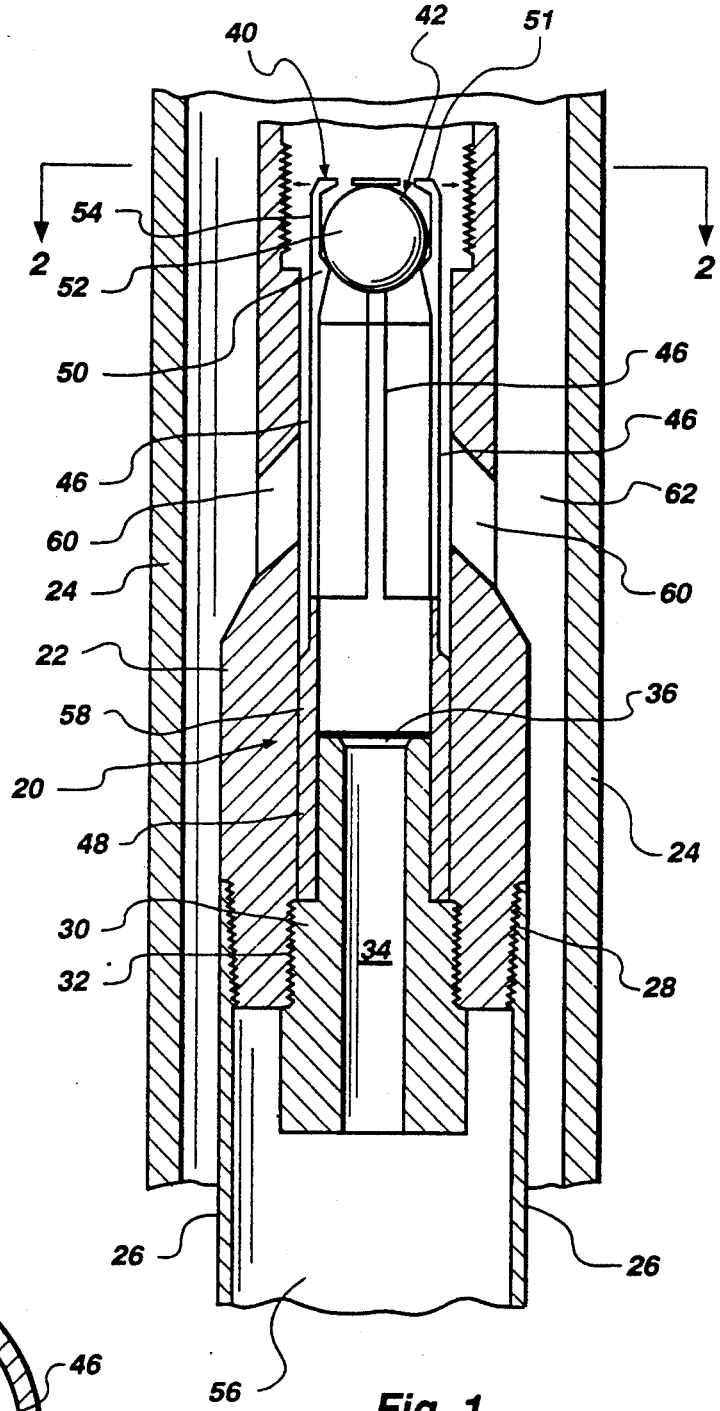
FIG. 1 is a view in longitudinal cross section of a preferred embodiment of the invention where the release mechanism, is a collet-type structure.

According to the invention, a preferred embodiment of the closure mechanism of the invention, generally at 20 in FIG. 1, is associated with an inner tube plug 22 in a core barrel 24. The closure mechanism 20 is generally positioned near the top of the inner tube 26 which is threaded or otherwise secured, at 28, to the inner tube plug 22. A pressure relief plug 30 is coaxially aligned with and threaded or otherwise secured, at 32, to the inner tube plug 22. The pressure relief plug 30 has a central longitudinal bore 34 and a seat 36 formed at the top thereof.

The closure mechanism 20 generally comprises a release mechanism 40 and occlusion means 42. As shown in FIG. 1, the release mechanism 40 may be a collet-type structure having a plurality of fingers 46. The term "collet," as used herein, refers to a structure having a base and finger member extending longitudinally from a base. The fingers 46 are attached to a collet sleeve 48 which is secured to the pressure relief plug 30. Each finger 46 has formed in the upper portion thereof a shoulder 50 which is directed inwardly.

An occlusion means 42 in the form of a ball 52 or other shaped plug member is positioned between each of the fingers 46 and is supported in place near the top 54 of the collet structure by the upsets or shoulders 50 of fingers 46. Ball 52 is also constrained from above by inwardly extending protrusions 51 at the top of fingers 46, thus being prevented from leaving closure mechanism 20 under back pressure or in horizontal drilling operations. Protrusions 51 extend inwardly above ball 52 at least as far as shoulders or upsets 50, and preferably greater, so as to provide absolute assurance that the ball 52 will be maintained in the closure mechanism. As illustrated further by FIG. 2, the fingers 46 enclose or cradle the ball 52 therebetween. The number of fingers 46 shown is four, but as few as two or as many as ten or more fingers may be used, depending upon the size of the assembly and the ball used therewith.

The fingers 46 of the release mechanism 40 are structured to remain substantially rigid and to retain the ball 52 therebetween when the flow rate of drilling fluid being pumped through the inner tube 26 is below a threshold level. That is, under typical operating conditions prior to coring, drilling fluid or mud is pumped down the inner bore of the drill string (not shown) to maintain circulation and to flush out the inner tube of the core barrel. The drilling fluid flows downwardly and circulates past the release mechanism 40 and the occlusion means 42, specifically ball 52, and flows through the central bore 34 of the pressure relief plug 30 into the inner tube interior 56 therebelow, as well as through apertures 60 in inner tube plug 22 into annular space 62 between the inner tube 26 and the outer housing of core barrel 24.

Immediately prior to commencement of coring, the occlusion means 40 is activated by increasing the flow rate of the drilling fluid to create an increase in pressure above closure mechanism 20. The positive differential pressure of drilling fluid above the ball 52 causes it to apply force to the shoulders 50 of the fingers 46. Drag of the drilling fluid flowing past ball 52 within plug 22 also acts upon ball 52 in a downward direction. Force exerted on the shoulders 50 by the ball 52, causes the fingers 46 to deflect or elastically bend radially outwardly a sufficient distance to allow the ball 52 to move downwardly past the shoulders 50 and to drop down between the fingers 46.

Upon release, the ball 52 comes into substantially immediate registration with the seat 36 of the pressure relief plug 30, thus occluding the central bore 34 and preventing fluid from entering into the interior 56 of the inner tube 26. The ball 52 fits snugly within the solid ring 58 formed by the collet sleeve 48 directly above the seat 36, and is maintained in position over the seat by differential pressure. When the central bore 34 is occluded, drilling fluid is completely diverted through apertures 60 and into the space 62.

The fingers 46 of the release mechanism may be formed of any material which retains substantial rigidity under average fluid flow rates existing during flushing of the inner tube, but resilient enough to elastically deflect or give slightly under increased fluid pressure or drag on ball 52. Such materials include metals, such as steel, and hard plastics. The type of drilling being done and the flow rates employed and therefore the forces applied to the ball 52 will determine the type of material used to form the release mechanism and the dimensions of fingers 46. The occlusion means 42 may take any form including a ball 52, as shown in FIG. 1, a frusto-conically or otherwise shaped plug, a disk, or the like. The occlusion means 42 may be formed of any material which will provide secure registration against the seat 36. Such materials include steel, resilient plastics, or natural or synthetic rubbers or the like.

Figure 2:
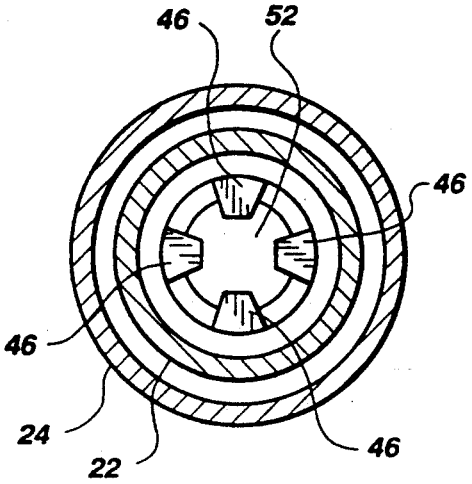
FIG. 2 is a view in cross section of the embodiment shown in FIG. 1, taken at line 2—2.

With the embodiment shown in FIGS. 1 and 2, the ball 52 may be retrieved from the seat 36 using a modified conventional resetting tool. The resetting tool (not shown), which may consist of a downwardly facing collet mechanism, or of a plurality of articulating grasping members, is inserted through the core barrel and into the closure mechanism 20. The collet fingers or articulating members grasp the ball 52 on seat 36 and raise the ball 52 until it reaches the upper part of the release mechanism 40. The ball 52 is repositioned between the fingers 46 of the release mechanism 40 above the shoulders 50, and below protrusions 51, which preclude removal of ball 52 from closure mechanism 20, due to the limited outward deflection of finger 46 permitted by the inner wall of inner tube plug 22. One of the many other possible resetting schemes would consist of a rod with concave end being inserted through the seat from the "bottom" or the inner tube side of the seat, thereby forcing the ball back into its first position between shoulders 50 and 51.

Figure 3:
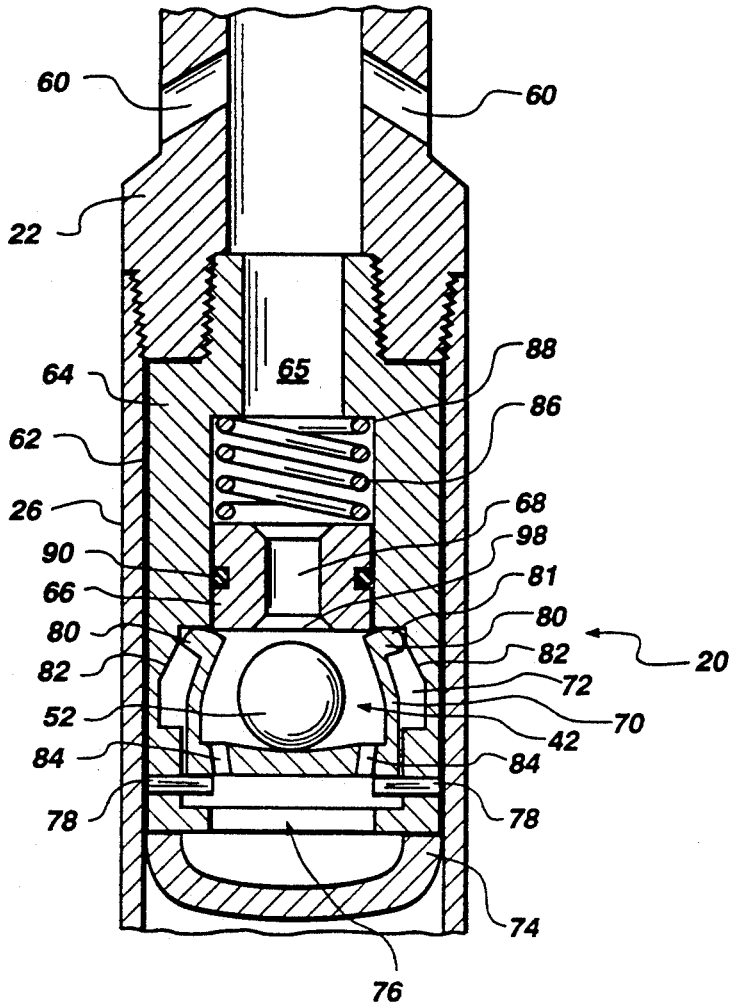
FIG. 3 is a view in longitudinal cross section of an alternative embodiment illustrating the occlusion means in a non-occluding position.
Figure 4:
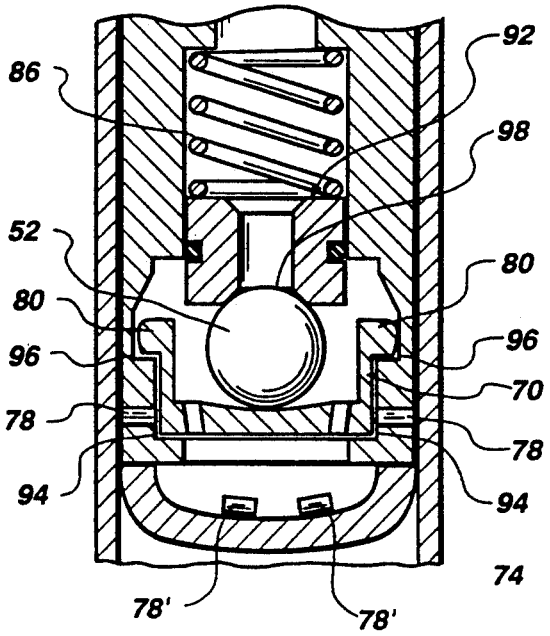
FIG. 4 is a view in longitudinal cross section of the embodiment shown in FIG. 3 illustrating the occlusion means in an occluding position.

In an alternative embodiment, illustrated by FIGS. 3 and 4, the closure mechanism 20 is associated with a fluid diversion structure 62 which is threadedly connected to the inner tube plug 22. The inner tube 26 is also threadedly connected to the inner tube plug 22. The fluid diversion structure 62 comprises an outer body 64, a central bore 65 through which drilling fluid flows, a valve insert 66 having a fluid channel 68 formed therethrough, a collet 70 positioned within an enlarged section 72 of the outer body 64 and a basket 74 positioned at the lower extremity of the outer body 64.

The collet 70 is positioned above a central aperture 76 formed in the outer body 64, and is held in place above the central aperture 76 by a plurality of shear pins 78. Further, the collet 70 has a plurality of fingers 80 which are bent or deflected inwardly to conform to a constriction 82 at the top of the enlarged section 72 when closure mechanism 20 is in the open position, as illustrated by FIG. 3. Fingers 80 include radially outwardly extending protrusions 81 at the top thereof. Occlusion means 42, here represented as a ball 52, is positioned within the collet 70 and is positioned centrally, surrounded by apertures 84 formed through the base of collet 70.

The valve insert 66 is slidably positioned within the central bore 65 of the outer body 64 and rests upon the inwardly flexed flanges 80 of the bracket 70 when in the open position. The valve insert 66 is held in place against the flanges 80 by a spring 86 biased between the valve insert 66 and a shoulder 88 of the outer body 64. An O-ring 90 is secured about the valve insert 66 to seal the space between the valve insert 66 and the central bore 65.

When the closure mechanism 20 is in the open position, as shown in FIG. 3, drilling fluid flows through the inner tube plug 22 and into the central bore 65 of the fluid diversion structure 62. The drilling fluid continues through the fluid channel 68 of the valve insert 66, into the enlarged section 72, past the ball 52 and through the small apertures 84 formed through the bracket 70. The fluid enters the central aperture 76 and flows through the basket 74 as it enters into the inner tube 26.

With an increase in fluid pressure resulting from a higher flow rate, increased force is exerted on the top 92 of the valve insert 66. As pressure increases, the valve insert 66 is forced downwardly against fingers 80. With sufficient pressure and associated force on valve insert 66, the shear pins 78 break allowing the collet 70 to drop to the bottom of the enlarged section 72 and fingers 80 are released to deflect outwardly to their normal, unloaded orientation. The broken fragments 78' of the shear pins 78 fall into the basket 74. The collet 70 comes to rest on a shoulder 94 formed in the bottom of the enlarged section 72, and protrusions 81 on the fingers 80 come to rest on an upwardly-facing shoulder 96 formed in the enlarged section 72. Outward deflection of fingers 81 allows the seat 98 of the valve insert 66 to move downwardly within collet 70 and into registration with the ball 52 to occlude the fluid channel 68. Spring 86 maintains insert 66 and ball 52 in registration. With occlusion of the fluid channel 68 the drilling fluid is diverted away from the inner tube into the fluid apertures 60 extending through the inner tube plug, illustrated in FIG. 3. Of course, the basket 74 may be eliminated by threading the inner ends of shear pins 78 into the base of collet 70.

Figure 5:
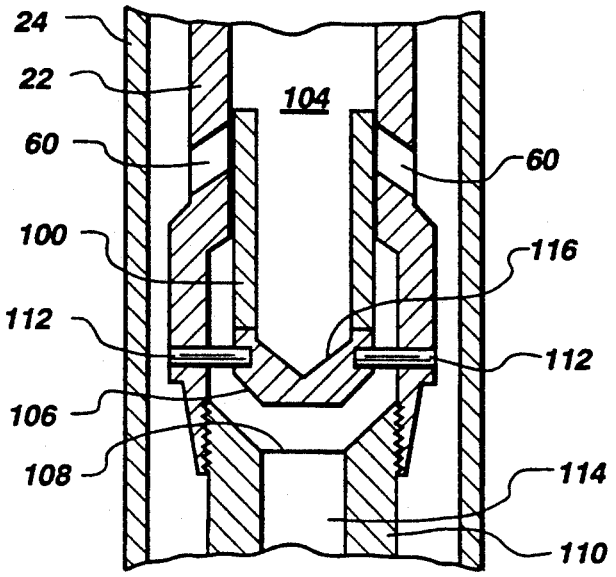
FIG. 5 is a view in longitudinal cross section of an alternative embodiment.
Figure 6:
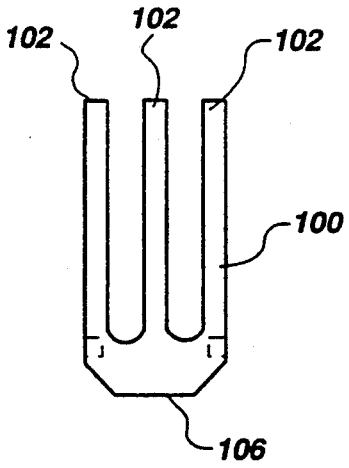
FIG. 6 is a front elevational view of the occlusion means of the embodiment shown in FIG. 5.

In another alternative embodiment, illustrated in FIGS. 5 and 6, a collet-type valve 100 having a plurality of fingers 102 is slidably positioned in the central bore 104 of an inner tube plug 22. The lower face 106 of the collet-type valve 100 is configured to register with a correspondingly configured seat 108 formed in a pressure relief plug 110 associated with the inner tube (not shown) and threadedly secured to the inner tube plug 22. The collet-type valve 100 is secured in position above the seat 108 by shear pins 112 which are interconnected between the collet-type valve 100 and the inner tube plug 22.

When drilling fluid is pumped down the drill string, it flows through the central bore 104 of the inner tube plug, through the fingers 102 of the collet-type valve 100 and through the channel 114 formed in the pressure relief plug 110. When fluid pressure is increased, force due to the increased volume of fluid and differential pressure effects is exerted on the inner surface 116 of the collet-type valve 100, urging it downwardly. With sufficient pressure and force, the shear pins 112 break, allowing the collet-type valve 100 to drop. The lower face 106 of valve 100 comes into registration with the seat 108 thereby occluding the channel 114 of the pressure relief plug 110 leading into the inner tube. Fluid is thereafter completely diverted through the apertures 60 formed in the inner tube plug 22. No catch mechanism or basket is required for shear pins 102, as they remain attached after shearing to inner tube plug 22 and valve 100.

Figure 7:
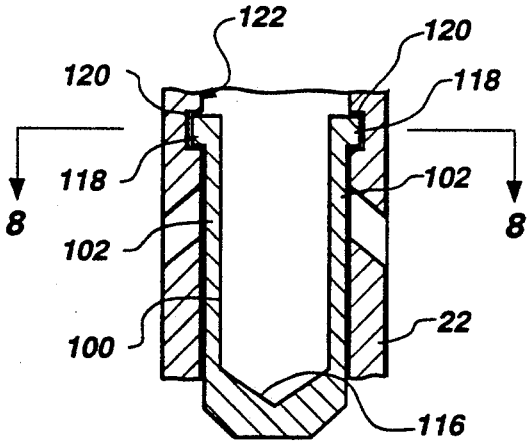
FIG. 7 is a view in longitudinal cross section of an alternative embodiment.
Figure 8:
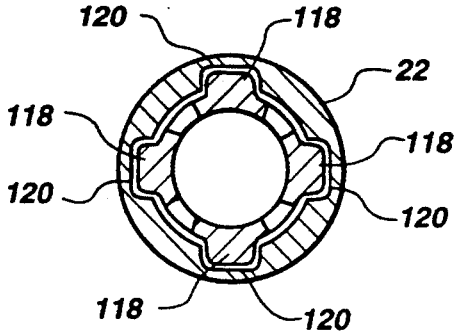
FIG. 8 is a view in cross section of the embodiment shown in FIG. 7 taken at line 7—7.

The collet-type valve 100 may be held in place within the inner tube plug 22 by alternative means as shown in FIGS. 7 and 8. The fingers 102 of the collet-type valve 100 may be formed with flanges 118 which engage pockets or cavities 120 formed in the interior wall 122 of the inner tube plug 22. Although a plurality of pockets 120 are illustrated, a single annular groove may be formed in the wall 122 of the inner tube plug 22, and in fact may be more easily machined than individual pockets. As fluid pressure increases and exerts force on the inner surface 116 of the collet-type valve 100, the flanges 118 are forced downwardly in the pockets 120 and are forced to flex inwardly until the flanges 118 disengage from the pockets 120, and collet-type valve 100 is forced downwardly and into registration with the seat 108.

Figure 9:
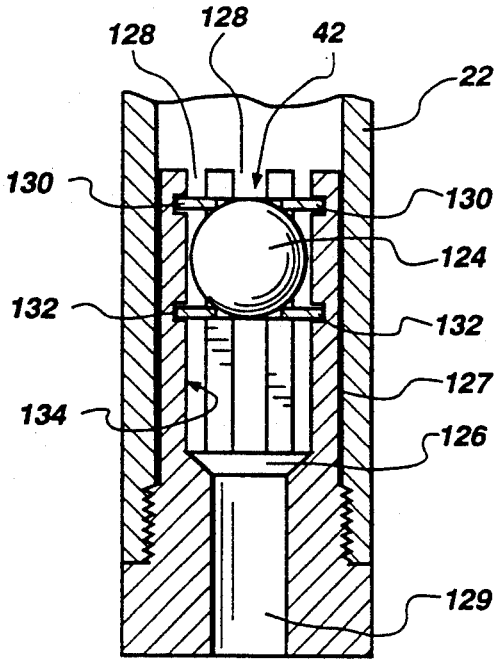
FIG. 9 is a view in longitudinal cross section of an alternative embodiment of the invention.

In another embodiment, the occlusion means 42, illustrated in FIG. 9 as a ball 124, is positioned above a seat 126 formed in a pressure relief plug 127 which is threadedly secured to the inner tube plug 22. The pressure relief plug 127 is structured with slots 128 to allow fluid to flow around the ball 124 and through the plug 127 into the fluid channel 129. Resilient annular means 130, 132 secured to the inner wall 134 of the pressure relief plug 127 retain the ball 124 therebetween.

The resilient annular means 130, 132 may be any flexible material which will retain the ball 124 above the seat 126 under normal pre-drilling flow conditions, but will flex under increased fluid pressure to allow the ball 124 to drop. Exemplary materials for the resilient annular means 130, 132 include an annular spring washer, a snap-ring sized to retain the ball 124 in place, an O-ring, and a spring clip. A conventional resetting tool may be used to retrieve and reset the ball 124 between the resilient annular means 130, 132 as required by the particular drilling conditions.

Figure 10:
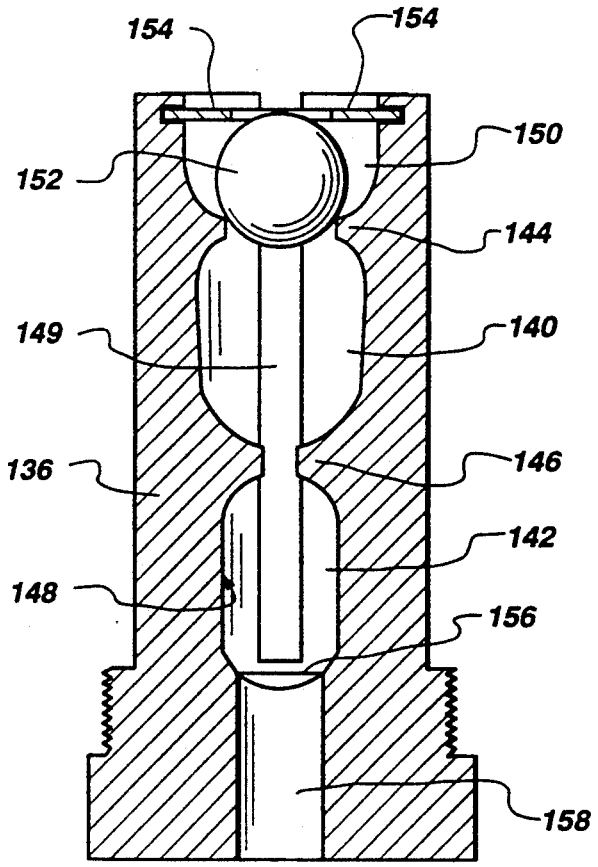
FIG. 10 is a view in longitudinal cross section of another alternative embodiment of the invention.

In another alternative embodiment illustrated by FIG. 10, the pressure relief plug 136 is configured with a number of interconnecting chambers 140, 142 demarcated by projections 144, 146 extending interiorly from the inner wall 148 of the pressure relief plug 136. The pressure relief plug 136 is configured with slots 149 to provide fluid flow therethrough. A partial chamber or bowl 150 is formed in the pressure relief plug 136 above the interconnecting chambers 140. A flexible ball 152, made of material such as rubber, is positioned in the partial chamber 150 between projection 144 and a resilient annular member 154 secured to the inner wall 148 of the pressure relief plug 136. The resilient annular member 154 is sized to engage enough of the ball 152 to prevent the ball from leaving the partial chamber 150. The resilient annular member 154 may be, for example, an annular spring washer, a snap-ring or a spring clip.

Under pre-drilling fluid flow conditions, the ball 152 is retained in the partial chamber or bowl 150. With an increase in fluid pressure, however, force is exerted on the flexible ball 152 forcing it downwardly. The ball 152 deforms under sufficient pressure and moves between the upper projections 144 to come to rest on the lower projections 146. Under still higher pressure, the ball 152 is deformed again until it moves past the lower projections 146. The ball 152 then drops to the seat 156 to occlude the fluid channel 158. The chamber 142 directly above the seat 156 may be sized to retain the ball 152 securely against the seat 156. Additionally, a friction fit between the ball 152 and the interior of chamber 142 secures the ball 152 against the seat 156. The embodiment of FIG. 10 thus provides a preliminary indication to the operator, through observed pressure increases, of the two-stage movement of ball 152 toward seat 156. Of course, if desired, seat 156 may be located at the position of lower projections 146, and slots 149 foreshortened to terminate above lower projections 146.

Figure 11:
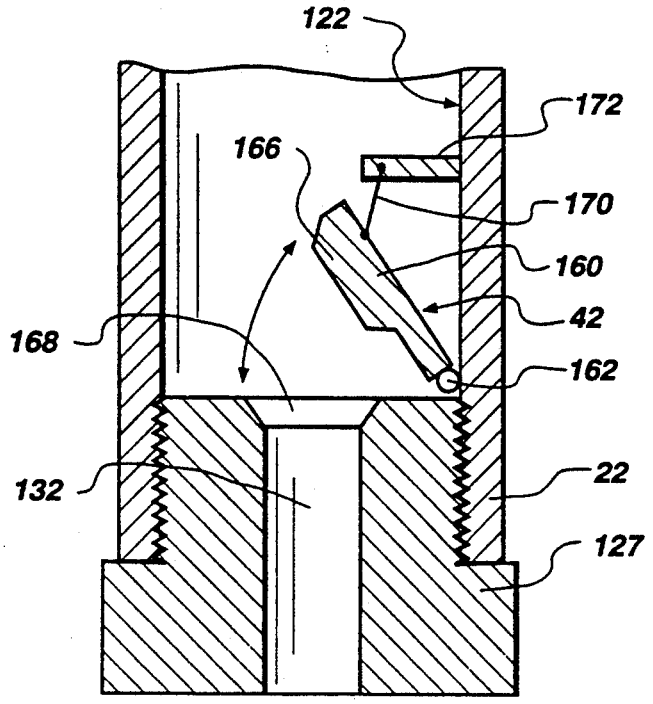
FIG. 11 is a view in longitudinal cross section of another alternative embodiment of the invention.

FIG. 11 illustrates another alternative embodiment in which the occlusion means 42 is a flapper valve 160 which is pivotally connected to the inner tube plug 22 by a hinge structure 162. Alternatively, the hinge structure 162 may be connected to the pressure relief plug 127. Further, the hinge structure 162 may be spring loaded in the direction of closure. The flapper valve 160 includes a lower face 166 which is configured to fit within a seat 168 formed in the pressure relief plug 127. The flapper valve 160 is held in an open position above the seat 168 by interconnection means 170 connecting the flapper valve 160 to an anchor pin 172 secured to the inner wall 122 of the inner tube plug 22. The interconnection means may be a string, a shear pin or screw, a wire or the like.

During pre-drilling flow conditions, fluid flows through the inner tube plug 22 and through the fluid channel 132. With sufficient increase in fluid pressure, the force exerted on the flapper valve 160 forces the interconnection means 170 to break allowing the flap valve 160 to pivot downwardly. The lower face 166 of the flapper valve 160 registers against the seat 168 of the pressure relief plug 127 occluding the fluid channel 132. The spring-loading of flapper valve 160 maintains flapper valve 160 in a closed position after release. Alternatively, a snap ring or ball-detent mechanism or other means known in the art may be employed for that purpose.

Figure 12:
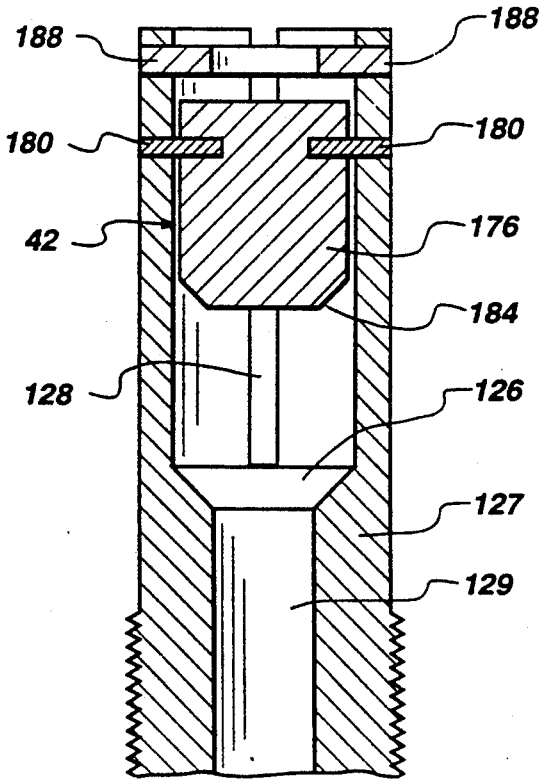
FIG. 12 is a view in longitudinal cross section of another alternative embodiment of the invention.

FIG. 12 illustrates another embodiment where the occlusion means 42 is a stopper 176 held above a seat 126 formed in connection with the fluid channel 129 of the pressure relief plug 127 by shear pins 180. The pressure relief plug 127 has slots 128 formed therein to allow fluid to circulate past stopper 176 through the pressure relief plug 127 via channel 129. The stopper 176 has a lower face 184 which is configured to register snugly against the seat 126. Under pre-drilling conditions, drilling fluid enters the pressure relief plug 127 through the slots 128 and flows through the fluid channel 129 thereof. Under increased fluid pressure, force is exerted on the stopper 176, causing the shear pins 180 to break. The stopper 176 drops downwardly and the lower face 184 comes into registration with the seat 126. A stop 188 formed at the top of the pressure relief plug 127 prevents the stopper 176 from moving upwardly through the pressure relief plug 127.

Figure 13:
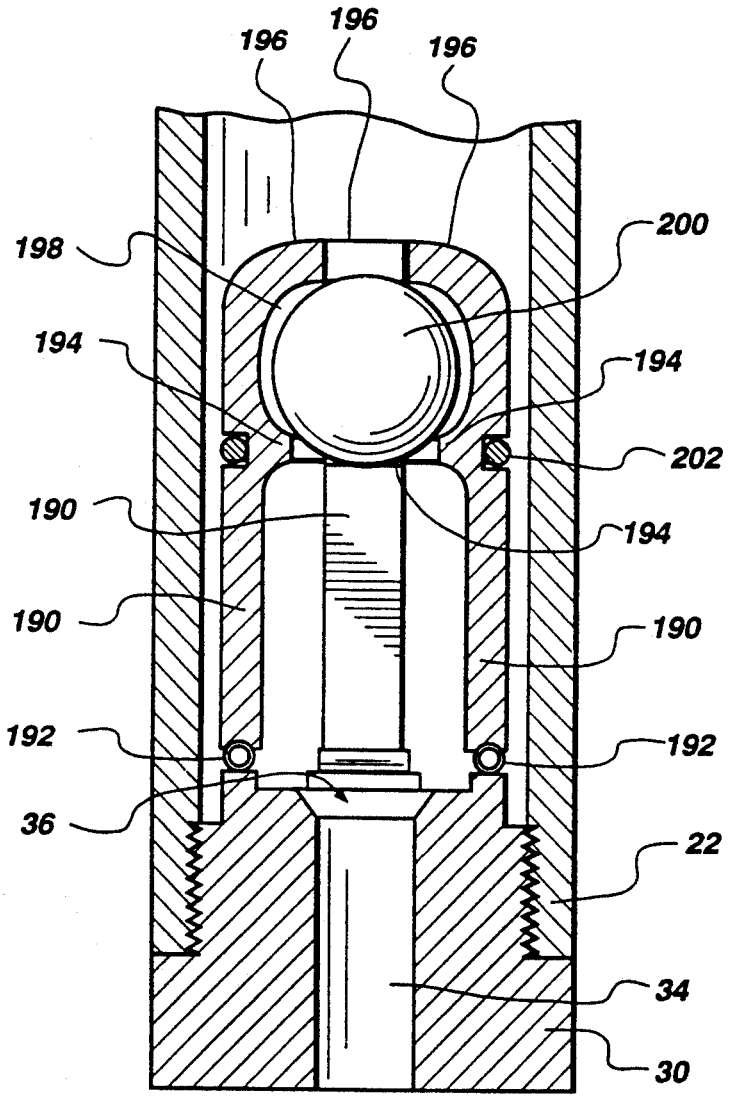
FIG. 13 is a view in longitudinal cross section of another alternative embodiment of the invention.

In another alternative embodiment illustrated by FIG. 13, a pressure relief plug 30 is threadedly secured to the inner tube plug 22. A plurality of fingers 190 are pivotally connected to the pressure relief plug 30 by hinge means 192. Each finger 190 is configured with a flange 194 extending inwardly therefrom and a hook 196 formed at the top of the finger 190. The convergence of the hooks 196 and flanges 194 form an enclosure or cradle 198 in which a ball 200 is positioned. A flexible band 202 encircling the fingers 190 keeps the fingers in proximity to each other during pre-drilling conditions.

Drilling fluid circulates about the fingers 190 and flows downwardly through the central bore 34 of the pressure relief plug 30 prior to drilling. With sufficient increase in flow rate and thus fluid pressure, a downward force on the top of the ball 200 causes a corresponding downward force on the flanges 194 by the ball 200. Force on the fingers 190, in addition to force on the ball 200, causes the fingers to spread or separate thereby allowing the ball 200 to move past the flanges 194 and to drop downwardly. The ball 200 comes into registration with the seat 36 preventing passage of fluid through the central bore 34 of the pressure relief plug 30. After the ball has dropped, the flexible band 202 urges the fingers 190 together again, and a lateral force is applied by the fingers 190 on the ball 200 thereby keeping the ball 200 positioned on the seat 36. A simple resetting tool may be used to push the ball and reset it in the enclosure 198 without disassembly of the mechanism, as required by the particular drilling conditions. The embodiment of FIG. 13 provides the operator with the ability to adjust the response of the mechanism to a variety of flow rates by merely changing out the bands 202 to provide different degrees of resiliency and holding force on fingers 190.

The present invention is directed to providing means for occluding fluid access to an inner tube of a core barrel assembly, which means are activated by conditions existing at the inner tube assembly. The present invention is further directed to providing occluding means which remain in registration with a seat to prevent fluid access to the inner tube during certain types of drilling such as horizontal drilling. The concept may be beneficial to other drilling applications and thus the structure of the invention may be modified to meet the demands of the particular application. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. A closure mechanism for preventing flow of fluid through an inner tube of a core barrel assembly comprising:

conduit structure associated with the inner tube of a core barrel assembly, said conduit structure having a fluid channel and a seat associated with said fluid channel;

occlusion means structured to reciprocally register with said seat;

releasing structure configured to maintain said occlusion means apart from said seat, and further configured to release said occlusion means to register with said seat in response to an increased flow rate of said fluid proximate said occlusion means; and structure for maintaining said released occlusion means in immediate proximity to said seat.

2. The mechanism of claim 1 wherein said releasing structure is a collet-type structure having a plurality of resilient fingers, said fingers having shoulders associated therewith to retain said occlusion means between said fingers in spaced relationship to said seat.

3. The mechanism of claim 2 wherein said structure for maintaining said occlusion means in immediate proximity to said seat is an annular base secured to said conduit structure adjacent said seat and defining an inner diameter substantially the same as the outer diameter of said occlusion means, and wherein said plurality of resilient fingers are secured to said annular base.

4. The mechanism of claim 3 wherein said occlusion means is a ball.

5. The mechanism of claim 2 wherein said plurality of fingers are pivotally connected to said conduit structure by hinge means, and wherein said releasing structure further includes a resilient band encircling said fingers.

6. The mechanism of claim 5 wherein said occlusion means is a ball.

7. The mechanism of claim 1 wherein said conduit structure has laterally extending openings formed in the walls thereof above said seat for accepting fluid flow diverted therethrough after registration of said occlusion means with said seat.

8. The mechanism of claim 7 further including a retaining member secured to said conduit structure above said occlusion means, and wherein said conduit structure further includes at least one level of inward projections thereon below said occlusion means and above said seat defining a chamber in said conduit structure, and said occlusion means is deformable, said releasing structure being defined by said inward projections and said occlusion means.

9. The mechanism of claim 8 wherein said deformable occlusion means is a deformable ball.

10. The mechanism of claim 9, wherein said chamber is of a diameter substantially the same as that of said ball in an undeformed state.

11. The mechanism of claim 7 further including a first resilient annular member secured to said conduit structure below said occlusion means and a second annular member secured to said conduit structure above said occlusion means, said first and said second annular members defining said releasing structure.

12. The mechanism of claim 7 further including a retention member secured to said conduit structure above said occlusion means, and wherein said releasing structure is a plurality of shear pins interconnected between said conduit structure and said occlusion means.

13. The mechanism of claim 12 wherein said occlusion means is a stopper.

14. The mechanism of claim 1 wherein said occlusion means is a collet-type valve comprising a base sized to reciprocally register with said seat and fingers projecting from said base, wherein said releasing structure is a plurality of shear pins interconnected between said conduit structure and said collet-type valve, and wherein said conduit structure includes at least one laterally extending channel therethrough above said seat and in communication with said fluid channel through said fingers.

15. The mechanism of claim 1 wherein said conduit structure has pockets formed therein, wherein said occlusion means is a collet-type valve comprising a base sized to reciprocally register with said seat and fingers projecting from said base, said fingers having protrusions formed thereon to engage said pockets in said conduit structure, and wherein said conduit structure includes at least one laterally extending channel therethrough above said seat and in communication with said fluid channel through said fingers.

16. The mechanism of claim 1 wherein said occlusion means is a flapper valve pivotally connected to said conduit structure, and wherein said releasing structure comprises anchor means secured to said conduit structure and releasable interconnection means connecting said flapper valve to said anchor means.

17. The mechanism of claim 16, further including means for maintaining said flapper valve in registration with said seat after release thereof.

18. A closure mechanism for preventing flow of fluid through the inner tube of a core barrel assembly comprising:

conduit structure associated with the inner tube of a core barrel assembly, said conduit structure including a movable insert having a longitudinal fluid channel therethrough and a seat associated with said fluid channel, said insert being configured to move within said conduit structure in response to an increased pressure differential occurring proximate said insert;

occlusion means structured to reciprocally register with said seat;

releasing structure configured to maintain said insert apart from said occlusion means; and securement structure for maintaining said occlusion means in registration with said seat after release of said insert.

19. The mechanism of claim 18 wherein said releasing structure is a collet having a base and fingers projecting from said base, said fingers having protrusions formed therein for engaging the conduit structure, and said occlusion means being positioned within said collet.

20. The mechanism of claim 19 further including shear pins interconnected between said conduit structure and said collet, and further including a basket structure for receiving portions of said shear pins upon breaking.

21. The mechanism of claim 20 wherein said securement structure is a spring disposed between said moveable insert and said conduit structure.

22. The mechanism of claim 21 wherein said occlusion means is a ball.

* * * * *